US011848501B2

(12) United States Patent
Kim et al.

(10) Patent No.: US 11,848,501 B2
(45) Date of Patent: Dec. 19, 2023

(54) ANTENNA ARRAY, ANTENNA DEVICE AND DISPLAY DEVICE INCLUDING THE SAME

(71) Applicant: DONGWOO FINE-CHEM CO., LTD., Jeollabuk-do (KR)

(72) Inventors: Jong Min Kim, Gyeonggi-do (KR); Young Su Lee, Gyeonggi-do (KR); Yoon Ho Huh, Seoul (KR)

(73) Assignee: DONGWOO FINE-CHEM CO., LTD., Jeollabuk-Do (KR)

( * ) Notice: Subject to any disclaimer, the term of this patent is extended or adjusted under 35 U.S.C. 154(b) by 92 days.

(21) Appl. No.: 17/579,834

(22) Filed: Jan. 20, 2022

(65) Prior Publication Data

US 2022/0231429 A1 Jul. 21, 2022

(30) Foreign Application Priority Data

Jan. 20, 2021 (KR) ..... 10-2021-0008377

(51) Int. Cl.
*H01Q 21/06* (2006.01)
*H01Q 1/44* (2006.01)
*H01Q 1/48* (2006.01)

(52) U.S. Cl.
CPC ..... *H01Q 21/065* (2013.01); *H01Q 1/44* (2013.01); *H01Q 1/48* (2013.01)

(58) Field of Classification Search
CPC .. H01Q 21/065; H01Q 1/38–48; H01Q 9/045; H01Q 9/0407
See application file for complete search history.

(56) References Cited

U.S. PATENT DOCUMENTS 4,914,445 A * 4/1990 Shoemaker ..... H01Q 9/0435 343/700 MS
7,705,782 B2 * 4/2010 Lee ..... H01Q 21/065 333/116

(Continued)

FOREIGN PATENT DOCUMENTS

JP 07176942 A 7/1995
KR 10-2002-0046238 A 6/2002

(Continued)

OTHER PUBLICATIONS

Office action dated Dec. 23, 2022 from Korean Patent Office in a counterpart Korean Patent Application No. 10-2022-0082487 (all the cited references are listed in this IDS.) (English translation is also submitted herewith.).

*Primary Examiner* — Hasan Islam
(74) *Attorney, Agent, or Firm* — The PL Law Group, PLLC

(57) ABSTRACT

An antenna array according to an embodiment includes antenna elements arranged in a predetermined direction. Each antenna element includes a first radiation body, a second radiation body to be spaced apart from the first radiation body in a first direction, a third radiation body to be spaced apart from the first radiation body in a second direction, a first signal pad and a second signal pad to supply signals to the first radiation body, a first transmission line extending in the first direction to connect the first signal pad and the first radiation body, a second transmission line extending in the second direction to connect the second signal pad and the first radiation body, a third transmission line configured to connect the first radiation body and the second radiation body, and a fourth transmission line configured to connect the first radiation body and the third radiation body.

20 Claims, 16 Drawing Sheets

(56) References Cited

U.S. PATENT DOCUMENTS

| | | | | |
|---|---|---|---|---|
| 11,175,759 | B2 * | 11/2021 | So | G06F 3/0443 |
| 2020/0194896 | A1 * | 6/2020 | Huh | B32B 7/12 |
| 2020/0403305 | A1 * | 12/2020 | Hsu | H01Q 1/523 |

FOREIGN PATENT DOCUMENTS

| | | | |
|---|---|---|---|
| KR | 10-2011-0123592 | A | 11/2011 |
| KR | 10-2013-0095451 | A | 8/2013 |
| KR | 10-1900839 | B1 | 9/2018 |
| KR | 10-1962820 | B1 | 3/2019 |
| KR | 10-1962821 | B1 | 7/2019 |
| KR | 10-2020-0007377 | A | 1/2020 |
| KR | 10-2020-0029161 | A | 3/2020 |
| KR | 10-2020-0038797 | A | 4/2020 |
| KR | 10-2021-0050452 | A | 5/2021 |
| KR | 10-2390288 | B1 | 4/2022 |
| KR | 10-2390289 | B1 | 4/2022 |
| KR | 10-2022-0087006 | A | 6/2022 |

* cited by examiner

ANTENNA ARRAY, ANTENNA DEVICE AND DISPLAY DEVICE INCLUDING THE SAME

CROSS-REFERENCE TO RELATED APPLICATION(S)

This application claims priority to Korean Patent Application No. 10-2021-0008377 filed on Jan. 20, 2021 in the Korean Intellectual Property Office (KIPO), the entire disclosure of which is incorporated by reference herein.

BACKGROUND

1. Field

The present invention relates to an antenna array, an antenna device and a display device including the same.

2. Description of the Related Art

Recently, according to development of the information-oriented society, wireless communication techniques such as Wi-Fi, Bluetooth, and the like are implemented, for example, in a form of smartphones by combining with display devices. In this case, an antenna may be coupled to the display device to perform a communication function.

Recently, with mobile communication techniques becoming more advanced, it is necessary for an antenna for performing communication in high frequency or ultra-high frequency bands to be coupled to the display device. In addition, according to development of thin, high-transparency and high-resolution display devices such as a transparent display and a flexible display, it is necessary to develop an antenna so as to also have improved transparency and flexibility.

As the size of a screen of the display device on which the antenna is mounted is increased, a space or area of a bezel part or light-shielding part has been decreased. In this case, the space or area in which the antenna can be embedded may also be limited.

Therefore, it is necessary to design an antenna capable of radiating a signal with a high antenna gain in a limited space without being viewed by a user.

SUMMARY

It is an object of the present invention to provide an antenna array, an antenna device and a display device including the same.

To achieve the above object, the following technical solutions are adopted in the present invention.

1. An antenna array including: a plurality of antenna elements arranged in a predetermined direction, wherein each antenna element includes: a first radiation body; a second radiation body disposed to be spaced apart from the first radiation body in a first direction; a third radiation body disposed to be spaced apart from the first radiation body in a second direction; a first signal pad and a second signal pad configured to supply signals to the first radiation body; a first transmission line extending in the first direction to connect the first signal pad and the first radiation body; a second transmission line extending in the second direction to connect the second signal pad and the first radiation body; a third transmission line configured to connect the first radiation body and the second radiation body; and a fourth transmission line configured to connect the first radiation body and the third radiation body.

2. The antenna array according to the above 1, wherein the plurality of antenna elements are arranged to share at least a portion thereof with each other.

3. The antenna array according to the above 2, wherein adjacent antenna elements share one radiation body with each other.

4. The antenna array according to the above 3, wherein the one radiation body serves as a second radiation body of one of the adjacent antenna elements and a third radiation body of the other one of the adjacent antenna elements.

5. The antenna array according to the above 2, further including: a bonding pad; and a ground line configured to connect the bonding pad and the radiation body shared by the adjacent antenna elements.

6. The antenna array according to the above 2, wherein each antenna element further includes: a first ground pad disposed around the first signal pad; and a second ground pad disposed around the second signal pad.

7. The antenna array according to the above 6, further comprising a ground line configured to connect the radiation body shared by the adjacent antenna elements and the first ground pad or the second ground pad.

8. The antenna array according to the above 1, wherein the plurality of antenna elements are arranged to be spaced apart from each other.

9. The antenna array according to the above 8, wherein a separation distance between the adjacent antenna elements is 0.5 mm or more.

10. The antenna array according to the above 8, further including: a boundary ground line disposed between the adjacent antenna elements; and a bonding pad connected to an end of the boundary ground line.

11. The antenna array according to the above 10, wherein the boundary ground line includes: a first segment extending in a longitudinal direction of the antenna element between the adjacent antenna elements; and a second segment connected with the first segment and surrounding the plurality of antenna elements.

12. The antenna array according to the above 8, wherein each antenna element further includes: a first ground pad disposed around the first signal pad; and a second ground pad disposed around the second signal pad.

13. The antenna array according to the above 12, further comprising a boundary ground line disposed between adjacent antenna elements.

14. The antenna array according to the above 13, wherein the boundary ground line includes: a first segment configured to connect a first ground pad of one of the adjacent antenna elements to a second ground pad of the other one of the adjacent antenna elements; a second segment surrounding the plurality of antenna elements; and a third segment extending between the adjacent antenna elements in the longitudinal direction of the antenna element to connect the first segment and the second segment.

15. The antenna array according to the above 1, wherein an angle between the first direction and the second direction is 80° to 100°.

16. The antenna array according to the above 1, wherein the first radiation body, the second radiation body and the third radiation body have a rhombus shape, the first transmission line and the second transmission line are connected to two adjacent sides of the first radiation body, respectively, the third transmission line connects two facing sides of the first radiation body and the second radiation body to each other; and the fourth transmission line connects two facing sides of the first radiation body and the third radiation body to each other.

17. The antenna array according to the above 1, wherein the first radiation body, the second radiation body and the third radiation body have a square shape, the first transmission line and the second transmission line are connected to two adjacent vertices of the first radiation body, respectively, the third transmission line connects two facing vertices of the first radiation body and the second radiation body to each other; and the fourth transmission line connects two facing vertices of the first radiation body and the third radiation body.

18. An antenna device including: the antenna array according to the above 1; and a flexible printed circuit board (FPCB) to which the antenna array is bonded and including a plurality of circuit wirings connected to the first signal pad and the second signal pad.

19. The antenna device according to the above 18, wherein the FPCB further includes: a plurality of grounds disposed at positions in which respective signal pads face each other with them interposed therebetween when the antenna array is bonded.

20. A display device comprising the antenna array according to the above 1 or the antenna device according to the above 18.

The antenna array according to an exemplary embodiment may include antenna elements in which a plurality of radiation bodies are connected in series in an extension direction of each of two transmission lines. Thereby, it is possible to implement a dual polarization antenna with improved antenna gain.

According to an exemplary embodiment, the antenna gain may be improved by arranging the plurality of antenna elements to be spaced apart from or overlapped with each other.

According to an exemplary embodiment, it is possible to reduce an occurrence of unwanted coupling between the radiation body and the ground pad by omitting the ground pad of each antenna element.

According to an exemplary embodiment, when arranging the plurality of antenna elements to be overlapped with each other, it is possible to reduce an occurrence of unwanted cross-coupling by connecting the radiation body shared by adjacent antenna elements to the ground.

According to an exemplary embodiment, when arranging the plurality of antenna elements to be spaced apart from each other, it is possible to reduce an occurrence of unwanted coupling between the adjacent antenna elements by disposing the ground line between the adjacent antenna elements.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION

Figure 1:
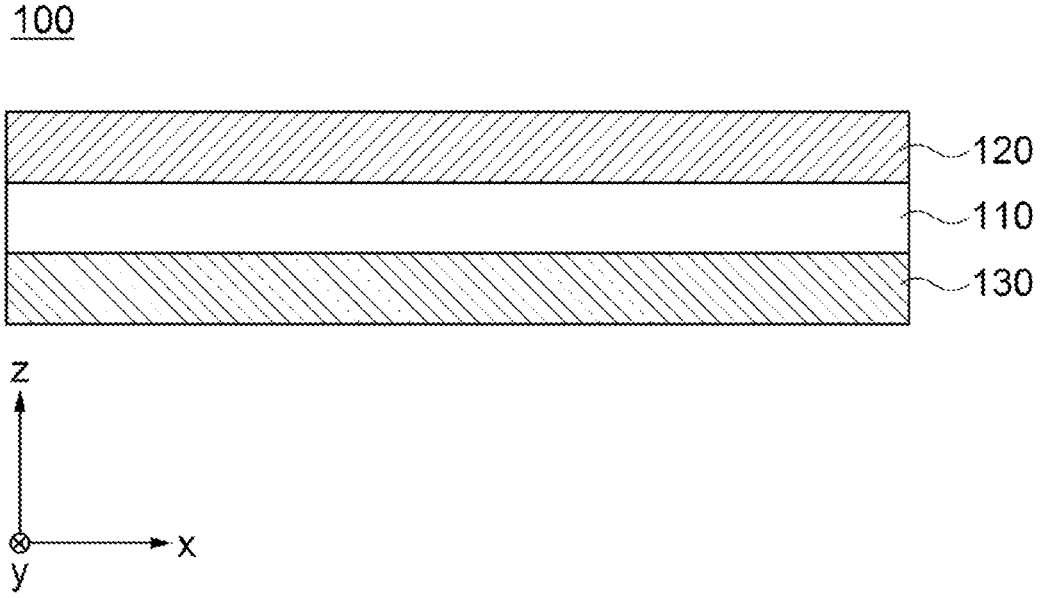
FIG. 1 is a schematic cross-sectional view illustrating an antenna element according to an exemplary embodiment.

Hereinafter, preferred embodiments of the present invention will be described in detail with reference to the accompanying drawings. However, since the drawings attached to the present disclosure are only given for illustrating one of preferable various embodiments of present invention to easily understand the technical spirit of the present invention with the above-described invention, it should not be construed as limited to such a description illustrated in the drawings.

An antenna element described in the present disclosure may be a patch antenna or a microstrip antenna manufactured in a form of a transparent film. For example, the antenna element may be applied to electronic devices for high frequency or ultra-high frequency (e.g., 3G, 4G, 5G or more) mobile communication, Wi-Fi, Bluetooth, near field communication (NFC), global positioning system (GPS), and the like, but it is not limited thereto. Herein, the electronic device may include a mobile phone, a smart phone, a tablet, a laptop computer, a personal digital assistant (PDA), a portable multimedia player (PMP), a navigation device, an MP3 player, a digital camera, a wearable device and the like. The wearable device may include a wristwatch type, a wrist band type, a ring type, a belt type, a necklace type, an ankle band type, a thigh band type, a forearm band type wearable device or the like. However, the electronic device is not limited to the above-described example, and the wearable device is also not limited to the above-described example. In addition, the antenna element may be applied to various objects or structures such as vehicles and buildings.

In the following drawings, two directions which are parallel to an upper surface of a dielectric layer and cross each other perpendicularly are defined as an x-direction and a y-direction, and a direction perpendicular to the upper surface of the dielectric layer is defined as a z-direction. For example, the x-direction may correspond to a width direction of the antenna element, the y-direction may correspond to a length direction of the antenna element, and the z-direction may correspond to a thickness direction of the antenna element.

FIG. 1 is a schematic cross-sectional view illustrating an antenna element according to an exemplary embodiment.

Referring to FIG. 1, an antenna element 100 according to an exemplary embodiment may include a dielectric layer 110 and an antenna pattern layer 120.

The dielectric layer 110 may include an insulation material having a predetermined dielectric constant. According to an embodiment, the dielectric layer 110 may include an inorganic insulation material such as glass, silicon oxide, silicon nitride, or metal oxide, or an organic insulation material such as an epoxy resin, an acrylic resin, or an imide resin. The dielectric layer 110 may function as a film substrate of the antenna element 100 on which the antenna pattern layer 120 is formed.

According to an embodiment, a transparent film may be provided as the dielectric layer 110. In this case, the transparent film may include a polyester resin such as polyethylene terephthalate, polyethylene isophthalate, polyethylene naphthalate, polybutylene terephthalate, etc.; a cellulose resin such as diacetyl cellulose, triacetyl cellulose, etc.; a polycarbonate resin; an acrylic resin such as polymethyl (meth)acrylate, polyethyl (meth)acrylate, etc.; a styrene resin such as polystyrene, acrylonitrile-styrene copolymer, etc.; a polyolefin resin such as polyethylene, polypropylene, cyclic polyolefin or polyolefin having a norbornene structure, ethylene-propylene copolymer, etc.; a vinyl chloride resin; an amide resin such as nylon, aromatic polyamide; an imide resin; a polyether sulfonic resin; a sulfonic resin; a polyether ether ketone resin; a polyphenylene sulfide resin; a vinylalcohol resin; a vinylidene chloride resin; a vinylbutyral resin; an allylate resin; a polyoxymethylene resin; a thermoplastic resin such as an epoxy resin and the like. These compounds may be used alone or in combination of two or more thereof. In addition, a transparent film made of a thermosetting resin or an ultraviolet curable resin such as (meth)acrylate, urethane, acrylic urethane, epoxy, silicone, and the like may be used as the dielectric layer 110.

According to an embodiment, an adhesive film such as an optically clear adhesive (OCA), an optically clear resin (OCR), and the like may also be included in the dielectric layer 110.

According to an embodiment, the dielectric layer 110 may be formed in a substantial single layer, or may be formed in a multilayer structure of two or more layers.

Capacitance or inductance may be generated by the dielectric layer 110, thus to adjust a frequency band which can be driven or sensed by the antenna element 100. When the dielectric constant of the dielectric layer 110 exceeds about 12, a driving frequency is excessively reduced, such that driving of the antenna in a desired high frequency band may not be implemented. Therefore, according to an embodiment, the dielectric constant of the dielectric layer 110 may be adjusted in a range of about 1.5 to 12, and preferably about 2 to 12. Further, according to an embodiment, the dielectric layer 110 may have a thickness of 4 μm to 1000 μm so that the antenna element 100 can be driven in a desired high frequency band. However, the present invention is not limited thereto, and the dielectric constant and thickness of the dielectric layer 110 may be variously altered according to a desired frequency band.

According to an embodiment, an insulation layer (e.g., an encapsulation layer, a passivation layer, etc. of a display panel) inside the display device on which the antenna element 100 is mounted may be provided as the dielectric layer 110.

The antenna pattern layer 120 may be disposed on an upper surface of the dielectric layer 110.

The antenna pattern layer 120 may include a low resistance metal such as silver (Ag), gold (Au), copper (Cu), aluminum (Al), platinum (Pt), palladium (Pd), chromium (Cr), titanium (Ti), tungsten (W), niobium (Nb), tantalum (Ta), vanadium (V), iron (Fe), manganese (Mn), cobalt (Co), nickel (Ni), zinc (Zn), tin (Sn), molybdenum (Mo), calcium (Ca), or an alloy including at least one thereof. These may be used alone or in combination of two or more thereof. For example, the antenna pattern layer 120 may include silver (Ag) or a silver alloy (e.g., a silver-palladium-copper (APC) alloy) to implement a low resistance. As another example, the antenna pattern layer 120 may include copper (Cu) or a copper alloy (e.g., a copper-calcium (CuCa) alloy) in consideration of low resistance and fine line width patterning.

According to an embodiment, the antenna pattern layer 120 may include a transparent conductive oxide such as indium tin oxide (ITO), indium zinc oxide (IZO), indium zinc tin oxide (IZTO), zinc oxide (ZnOx), or copper oxide (CuO).

According to an embodiment, the antenna pattern layer 120 may include a lamination structure of a transparent conductive oxide layer and metal layer, for example, may have a two-layer structure of transparent conductive oxide layer-metal layer or a three-layer structure of transparent conductive oxide layer-metal layer-transparent conductive oxide layer. In this case, resistance may be reduced to improve signal transmission speed while improving flexible properties by the metal layer, and corrosion resistance and transparency may be improved by the transparent conductive oxide layer.

Specific details of the antenna pattern layer 120 will be described below with reference to FIGS. 2 and 3.

According to an embodiment, the antenna element 100 may further include a ground layer 130. Since the antenna element 100 includes the ground layer 130, vertical radiation characteristics may be implemented.

The ground layer 130 may be disposed on a lower surface of the dielectric layer 110. The ground layer 130 may be overlapped with the antenna pattern layer 120 with the dielectric layer 110 interposed therebetween. For example, the ground layer 130 may be entirely overlapped with radiation bodies (see 211, 212 and 213 in FIG. 2) of the antenna pattern layer 120.

According to an embodiment, a conductive member of the display device or display panel on which the antenna element 100 is mounted may be provided as the ground layer 130. For example, the conductive member may include electrodes or wirings such as a gate electrode, source/drain electrodes, pixel electrode, common electrode, data line, scan line, etc. of a thin film transistor (TFT) included in the display panel; and a stainless steel (SUS) plate, heat radiation sheet, digitizer, electromagnetic wave shielding layer, pressure sensor, fingerprint sensor, etc. of the display device.

Figure 2:
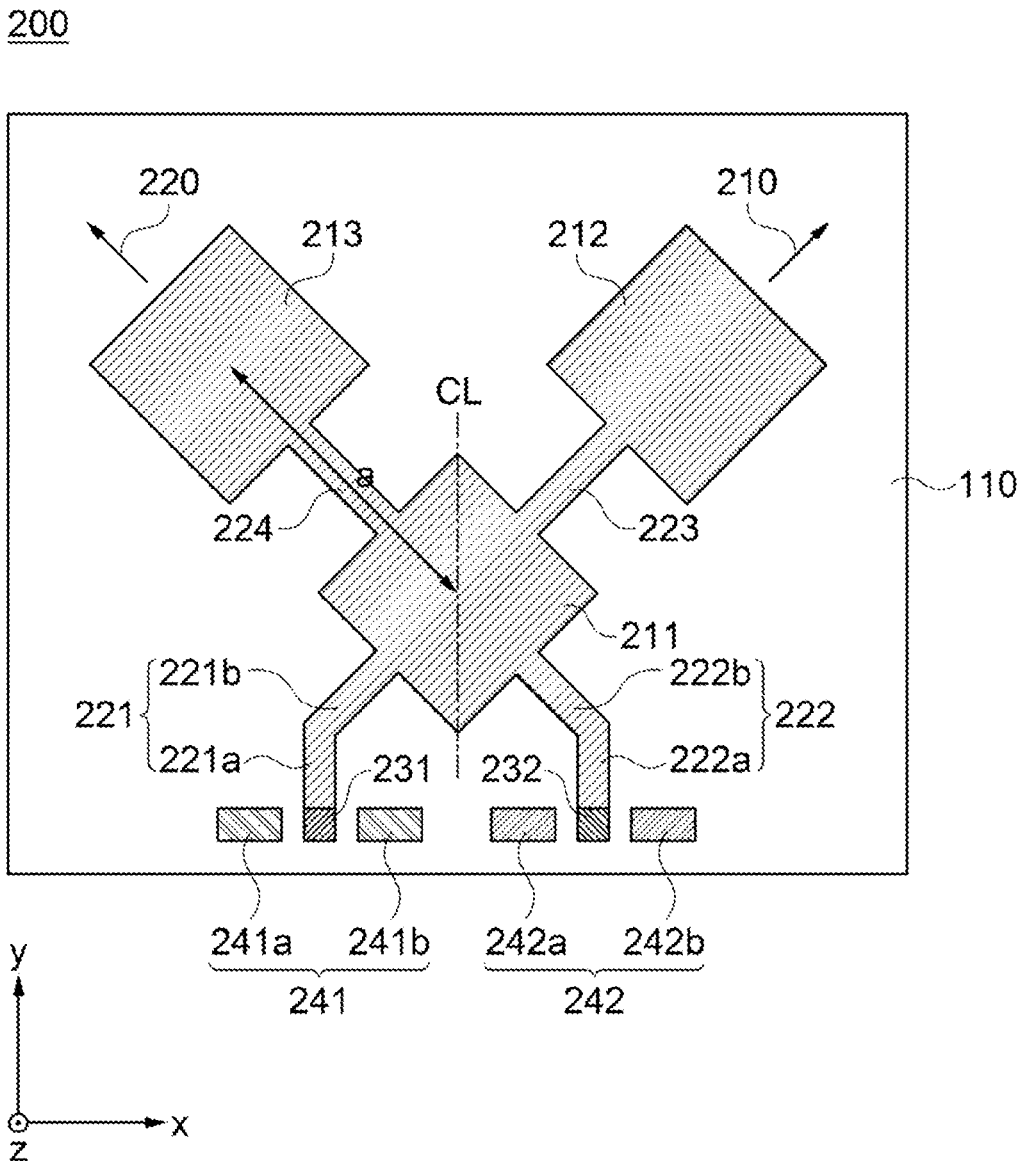
FIG. 2 is a schematic plan view illustrating an antenna element according to an exemplary embodiment.

FIG. 2 is a schematic plan view illustrating an antenna element according to an exemplary embodiment. An antenna element 200 of FIG. 2 may be an embodiment of the antenna element 100 shown in FIG. 1.

Referring to FIGS. 1 and 2, the antenna element 200 according to the exemplary embodiment includes the antenna pattern layer 120 disposed on the dielectric layer 110, and the antenna pattern layer 120 may include a first radiation body 211, a second radiation body 212, a third radiation body 213, a first transmission line 221, a second transmission line 222, a first signal pad 231 and a second signal pad 232.

The first radiation body 211 and the second radiation body 212 may receive an electric signal from the first signal pad 231, convert it into an electromagnetic wave signal, and radiate the converted electromagnetic wave signal. In addition, the first radiation body 211 and the third radiation body 213 may receive an electric signal from the second signal pad 232, convert it into an electromagnetic wave signal, and radiate the converted electromagnetic wave signal.

The first radiation body 211, the second radiation body 212 and the third radiation body 213 may have substantially the same resonance frequency. To this end, shapes and sizes (lengths and widths) of the first radiation body 211, the second radiation body 212 and the third radiation body 213 may be substantially the same as each other. The lengths and widths of the first radiation body 211, the second radiation body 212 and the third radiation body 213 may be determined according to the desired resonance frequency, radiation resistance and gain.

According to an exemplary embodiment, the first radiation body 211, the second radiation body 212 and the third radiation body 213 may have a rhombus shape, and may be formed in a mesh structure, a solid structure (thin film or thick film), or a structure in which the mesh structure and the solid structure are mixed. When the first radiation body 211, the second radiation body 212 and the third radiation body 213 are formed in a mesh structure, transmittances of the first radiation body 211, the second radiation body 212 and the third radiation body 213 may be increased, and flexibility of the antenna element 200 may be improved. Accordingly, the antenna element 200 may be effectively applied to a flexible display device.

The first radiation body 211 may be connected to the first signal pad 231 through the first transmission line 221 extending in a first direction 210, and may be connected to the second signal pad 232 through the second transmission line 222 extending in a second direction 220. Herein, the first direction 210 and the second direction 220 may be perpendicular to a thickness direction (z-direction) of the antenna element 100 and may intersect a length direction (y-direction) of the antenna element 100. In addition, the first direction 210 and the second direction 220 may intersect each other. For example, an angle between the first direction 210 and the second direction 220 may be 80° to 100°, and preferably 90°. By forming the extension directions of the first transmission line 221 and the second transmission line 222 to be orthogonal to each other, the dual polarization antenna may be effectively implemented.

The second radiation body 212 may be disposed to be spaced apart from the first radiation body 211 in the first direction 210. The second radiation body 212 may be connected to the first radiation body 211 through the third transmission line 223 extending in the first direction 210. Thereby, the first transmission line 221, the first radiation body 211, the third transmission line 223 and the second radiation body 212 may form one serial power supply antenna.

The third radiation body 213 may be disposed to be spaced apart from the first radiation body 211 in the second direction 220. The third radiation body 213 may be connected to the first radiation body 211 through a fourth transmission line 224 extending in the second direction 220. Thereby, the second transmission line 222, the first radiation body 211, the fourth transmission line 224 and the third radiation body 213 may form another serial power supply antenna.

According to an exemplary embodiment, in order to reduce an interference between the first radiation body 211 and the second radiation body 212, and an interference between the first radiation body 211 and the third radiation body 213, a distance between a center of the first radiation body 211 and a center of the second radiation body 212, and a distance between a center of the first radiation body 211 and a center of the third radiation body 213 may be 212 or more.

According to an exemplary embodiment, the second radiation body 212 and the third radiation body 213 may be formed symmetrically based on a center line CL of the first radiation body 211. In this case, the center line CL of the first radiation body 211 may be defined as an imaginary line passing through the center of the first radiation body 211 and parallel to a longitudinal direction (y-direction) of the antenna element 200.

The first transmission line 221 may connect the first signal pad 231 and the first radiation body 211. According to an exemplary embodiment, the first transmission line 221 may be bent. For example, the first transmission line 221 may include a first segment 221*a* extending from the first signal pad 231 in the longitudinal direction (y-direction) of the antenna element 200, and a second segment 221*b* extending from the first segment 221*a* in the first direction 210 to be connected to the first radiation body 211.

The second transmission line 222 may connect the second signal pad 232 and the first radiation body 211. According to an exemplary embodiment, the second transmission line 221 may be curved. For example, the second transmission line 222 includes a first segment 222*a* extending from the second signal pad 232 in the longitudinal direction (y-direction) of the antenna element 200, and a second segment 222*b* extending from the first segment 222*a* in the second direction 220 to be connected to the first radiation body 211.

According to an exemplary embodiment, the first transmission line 221 and the second transmission line 222 may be connected to two adjacent sides of the first radiation body 211, respectively. In this case, the first transmission line 221 and the second transmission line 222 may be connected to the center of each side.

The third transmission line 223 may connect the first radiation body 211 and the second radiation body 212. According to an exemplary embodiment, the third transmission line 223 may extend from the first radiation body 211 in the first direction 210 to be connected to the second radiation body 212. For example, the third transmission line 223 may connect the centers of two facing sides of the first radiation body 211 and the second radiation body 212 to each other.

The fourth transmission line 224 may connect the first radiation body 211 and the third radiation body 213. According to an exemplary embodiment, the fourth transmission line 224 may extend from the first radiation body 211 in the second direction 220 to be connected to the third radiation body 213. For example, the fourth transmission line 224 may connect the centers of two facing sides of the first radiation body 211 and the third radiation body 213 to each other.

According to an exemplary embodiment, the first transmission line 221, the second transmission line 222, the third transmission line 223 and the fourth transmission line 224 may include substantially the same conductive material as the first radiation body 211, the second radiation body 212 and the third radiation body 213. In addition, the first transmission line 221, the second transmission line 222, the third transmission line 223 and the fourth transmission line 224 may be integrally connected to the first radiation body 211, the second radiation body 212 and the third radiation body 213 to be formed as a substantial single member, or may be formed as a separate member from the first radiation body 211, the second radiation body 212 and the third radiation body 213.

According to an exemplary embodiment, the first transmission line 221, the second transmission line 222, the third transmission line 223 and the fourth transmission line 224 may be formed in a mesh structure, a solid structure (thin film or thick film), or a structure in which the mesh structure and the solid structure are mixed.

According to an exemplary embodiment, the first transmission line 221 and the second transmission line 222 may be formed symmetrically based on the center line CL of the first radiation body 211. In addition, the third transmission line 223 and the fourth transmission line 224 may be formed symmetrically based on the center line CL of the first radiation body 211.

The first signal pad 231 may be connected to the first transmission line 221 and may be electrically connected to the first radiation body 211 through the first transmission line 221. The second signal pad 232 may be connected to the second transmission line 222 and may be electrically connected to the first radiation body 211 through the second transmission line 222. Thereby, the first signal pad 231 and the second signal pad 232 may electrically connect an antenna driving unit (e.g., a radio frequency integrated circuit (RFIC), etc.) and the first radiation body 211, respectively. For example, a flexible printed circuit board (FPCB) is bonded to the first signal pad 231 and the second signal pad 232, and a circuit wiring of the FPCB may be electrically connected to the first signal pad 231 and the second signal pad 232. For example, the first signal pad 231 and the second signal pad 232 may be electrically connected to the FPCB using an anisotropic conductive film (ACF) bonding technique, which is a bonding method that allows electrical conduction up and down and insulates left and right using an anisotropic conductive film (ACF), or using a coaxial cable, but it is not limited thereto. The antenna driving unit may be mounted on the FPCB or a separate printed circuit board (PCB) to be electrically connected to the circuit wiring of the FPCB. Accordingly, the first radiation body 211 and the antenna driving unit may be electrically connected.

According to an exemplary embodiment, the first signal pad 231 and the second signal pad 232 may include substantially the same conductive material as the first transmission line 221 and the second transmission line 222. In addition, the first signal pad 231 and the second signal pad 232 may be integrally connected to the first transmission line 221 and the second transmission line 222 to be formed as a substantial single member, respectively, or may be formed as separate members from the first transmission line 221 and the second transmission line 222.

According to an exemplary embodiment, the first signal pad 231 and the second signal pad 232 may be formed in a solid structure. In addition, the first signal pad 231 and the second signal pad 232 may be formed symmetrically based on the center line CL of the first radiation body 211.

According to an exemplary embodiment, the antenna pattern layer 120 may further include a first ground pad 241 and a second ground pad 242.

The first ground pad 241 may be disposed around the first signal pad 231 to be electrically and physically spaced apart from the first signal pad 231. For example, the first ground pad 241 may include two first ground pads 241*a* and 241*b* which are disposed to face each other with the first signal pad 231 interposed therebetween.

The second ground pad 242 may be disposed around the second signal pad 232 to be electrically and physically spaced apart from the second signal pad 232. For example, the second ground pad 242 may include two second ground pads 242*a* and 242*b* disposed to face each other with the second signal pad 232 interposed therebetween.

The first ground pad 241 and the second ground pad 242 may be formed in a solid structure including the above-described metal or alloy.

Meanwhile, FIG. 2 illustrates an example in which the first transmission line 221 and the second transmission line 222 are bent, but this is only an exemplary embodiment. That is, the first transmission line 221 may include only the second segment 221*b*, and the first segment 221*a* may be included in the first signal pad 231. Similarly, the second transmission line 222 may include only the second segment 222*b*, and the first segment 222*a* may be included in the second signal pad 232.

In addition, according to an exemplary embodiment, when the antenna pattern layer 120 includes the first ground pad 241 and the second ground pad 242, the first ground pad 241*b* and the second ground pad 242*a* may also be connected to each other to form one ground pad.

Further, according to an exemplary embodiment, when the radiation bodies 211, 212 and 213, and the transmission lines 221, 222, 223 and 224 are formed in a mesh structure, a dummy pattern (not shown) may be formed around the radiation bodies 211, 212 and 213, and the transmission lines 221, 222, 223 and 224. The dummy pattern may be electrically and physically separated from the radiation bodies 211, 212 and 213, and the transmission lines 221, 222, 223 and 224. Furthermore, the dummy pattern may include substantially the same conductive material as the radiation bodies 211, 212 and 213 and/or the transmission lines 221, 222, 223 and 224. According to an exemplary embodiment, the dummy pattern may be formed in a segmented mesh structure.

As the dummy pattern is disposed around the radiation bodies 211, 212 and 213, and the transmission lines 221, 222, 223 and 224, optical uniformity of the pattern may be improved, thereby preventing the antenna pattern from being viewed by the user.

Figure 3:
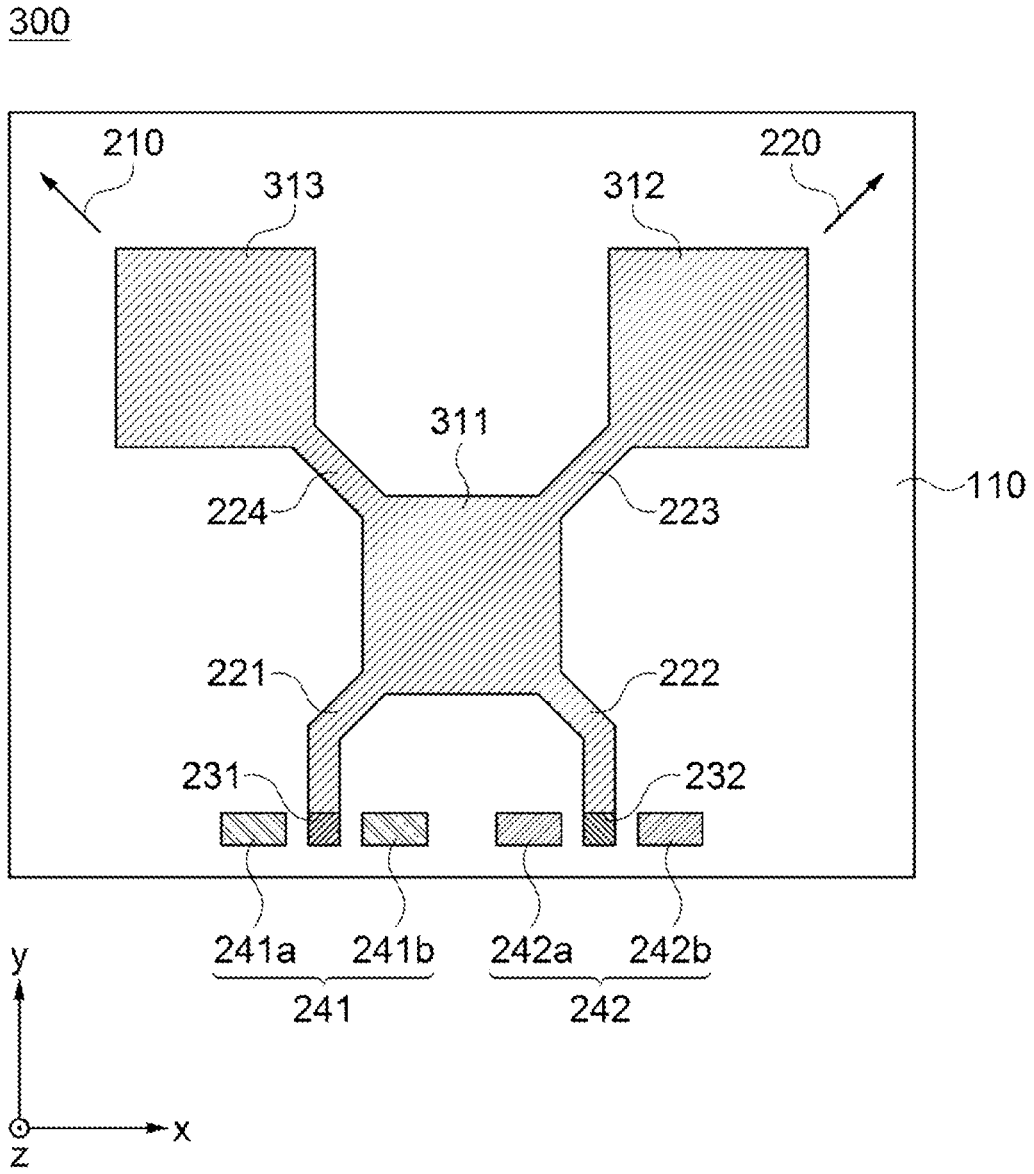
FIG. 3 is a schematic plan view illustrating an antenna element according to another exemplary embodiment.

FIG. 3 is a schematic plan view illustrating an antenna element according to another exemplary embodiment. An antenna element 300 of FIG. 3 may be an embodiment of the antenna element 100 shown in FIG. 1. Details of the contents substantially the same as those of the structures and configurations described with reference to FIGS. 1 and 2 will not be described. In addition, a first radiation body 311, a second radiation body 312 and a third radiation body 313 are the same as the first radiation body 211, the second radiation body 212 and the third radiation body 213, and therefore will not be described in detail within the overlapping range.

Referring to FIG. 3, the first radiation body 311, the second radiation body 312 and the third radiation body 313 of the antenna element 300 may have a square shape, respectively.

In this case, a first transmission line 221 and a second transmission line 222 may be respectively connected to two adjacent vertices of the first radiation body 311. Also, a third transmission line 223 may connect two facing vertices of the first radiation body 311 and the second radiation body 312 to each other, and a fourth transmission line 224 may connect two facing vertices of the first radiation body 311 and the third radiation body 313 to each other.

Meanwhile, FIG. 2 illustrates an example in which the radiation bodies 211, 212 and 213 have a rhombus shape, and FIG. 3 illustrates an example in which the radiation bodies 311, 312, and 313 have a square shape, but these are only exemplary embodiments. That is, there is no particular limitation on the shapes of the radiation bodies 211, 212, 213, 311, 312 and 313, and these radiation bodies may have various planar shapes such as a circle and a polygon.

FIG. 4A to FIG. 11 are plan views illustrating antenna arrays according to exemplary embodiments. In the description of FIGS. 4A to FIG. 11, details of the contents substantially the same as those of the structures and configurations described with reference to FIGS. 1 to 3 will not be described.

Figure 4A:
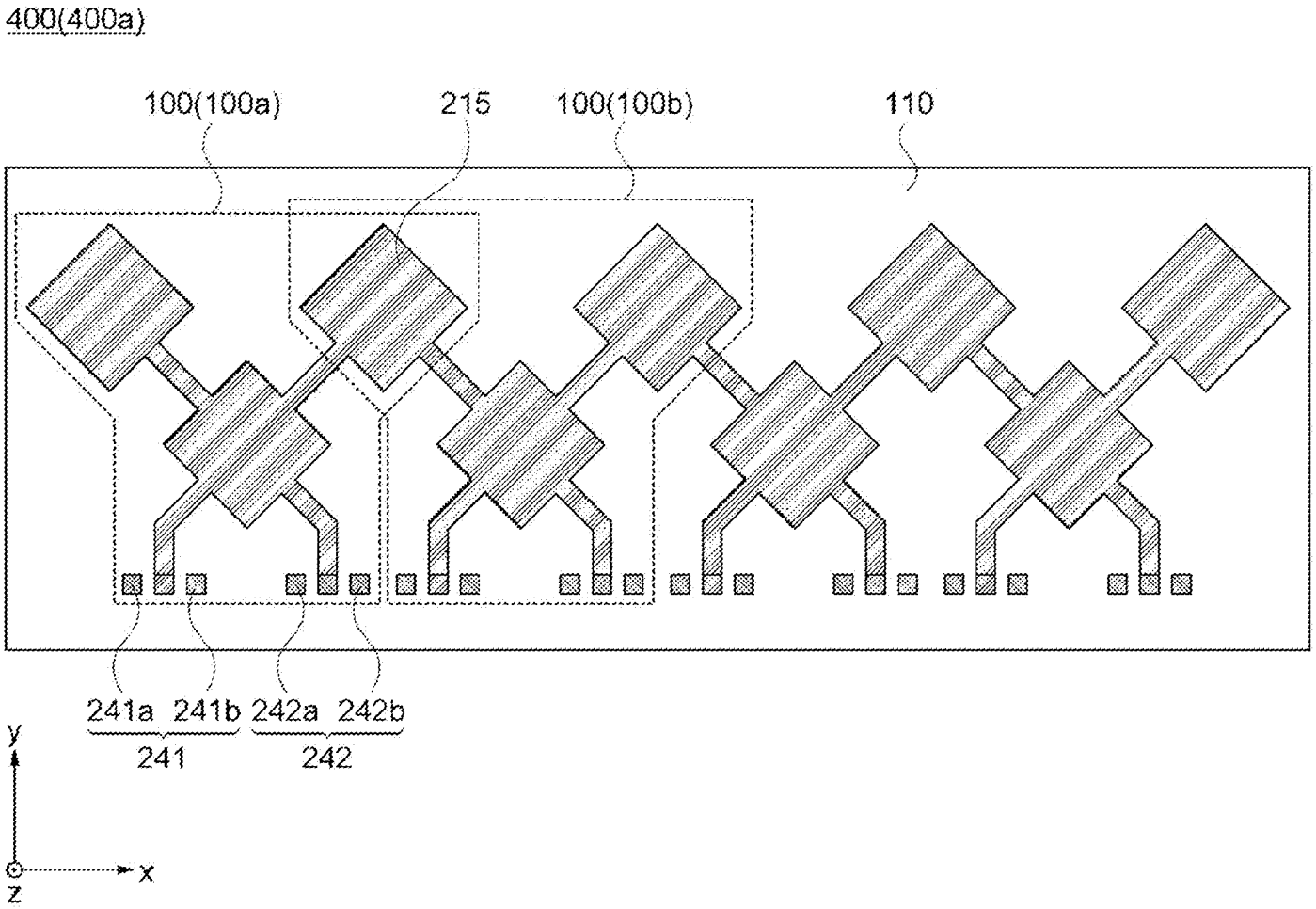
FIG. 4A to FIG. 11 are plan views illustrating antenna arrays according to exemplary embodiments.
Figure 4B:
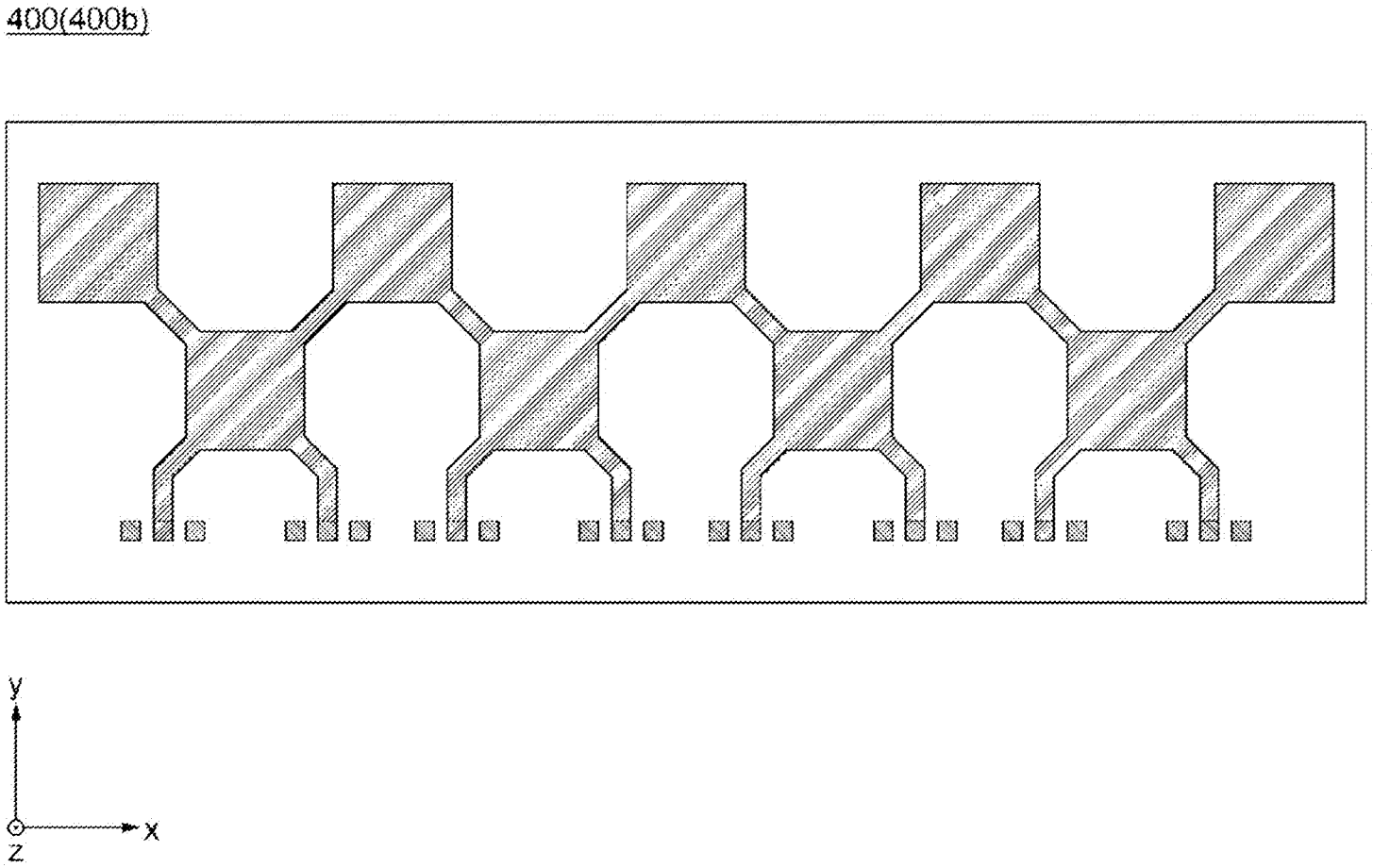

Referring to FIGS. 4A and 4B, an antenna array 400 according to an exemplary embodiment may include a plurality of antenna elements 100 arranged while sharing at least a portion thereof with each other in the width direction (x-direction) of the antenna element 100. In this case, the antenna element 100 may include ground pads 241 and 242.

Adjacent antenna elements 100*a* and 100*b* may share one radiation body 215 with each other. For example, the radiation body 215 may be a second radiation body 212 of a first antenna element 100*a* and a third radiation body 213 of a second antenna element 100*b*. That is, the radiation body 215 may serve as the second radiation body 212 of the first antenna element 100*a* and as the third radiation body 213 of the second antenna element 100*b*.

Figure 5:
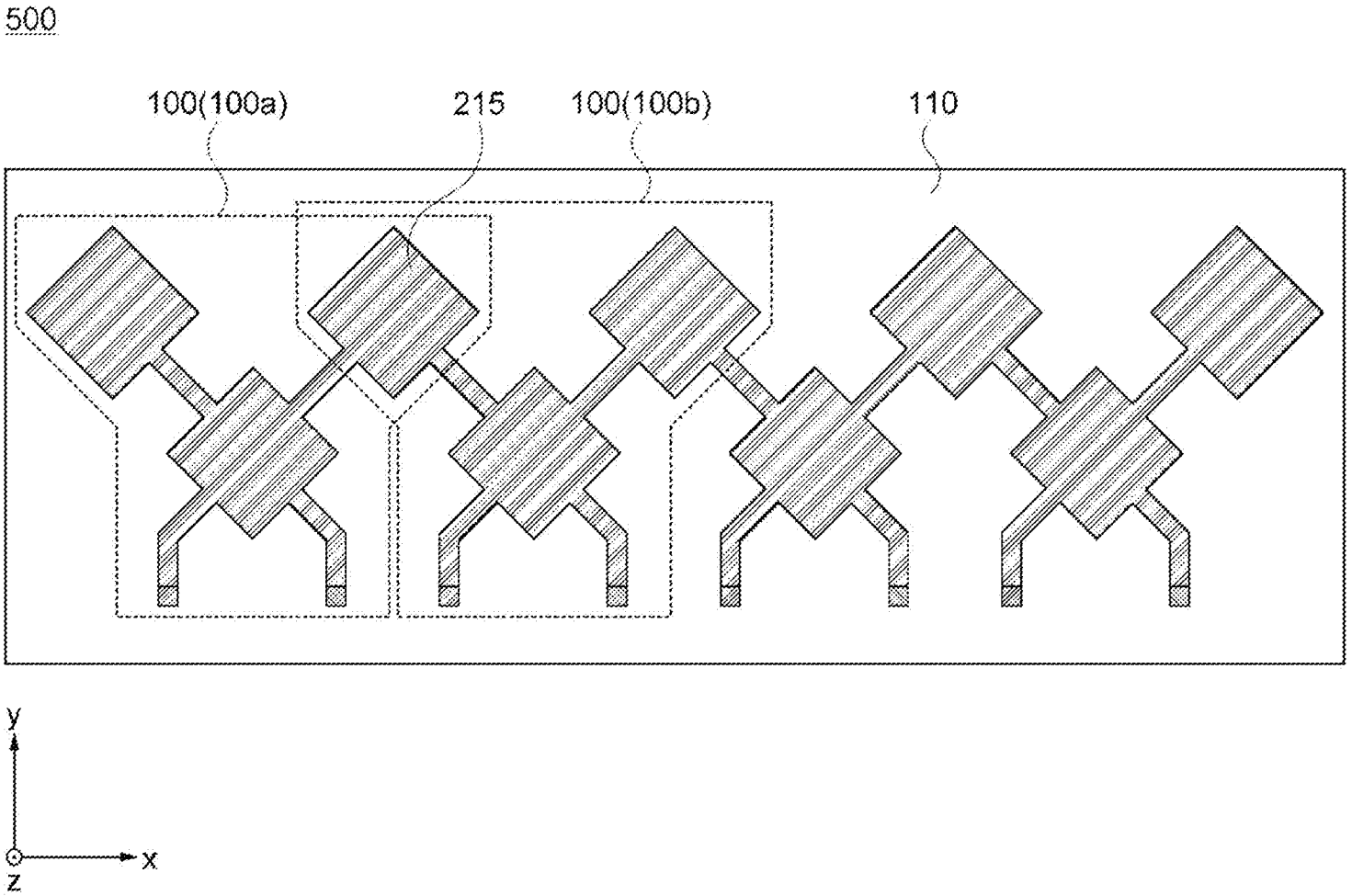

Referring to FIG. 5, unlike the embodiment shown in FIGS. 4A and 4B, the ground pads 241 and 242 may be omitted in an antenna array 500 according to an exemplary embodiment.

When the radiation bodies 211, 212 and 213 are located close to the ground pads 241 and 242, unwanted coupling may occur between the radiation bodies 211, 212 and 213, and the ground pads 241 and 242. Such the unwanted coupling may affect isolation and radiation efficiency of the antenna. Therefore, according to an exemplary embodiment, the ground pads 241 and 242 of the antenna element 100 may be removed so as to reduce an occurrence of the unwanted coupling between the radiation bodies 211, 212, 213, 311, 312 and 313, and the ground pads 241 and 242.

Figure 6:
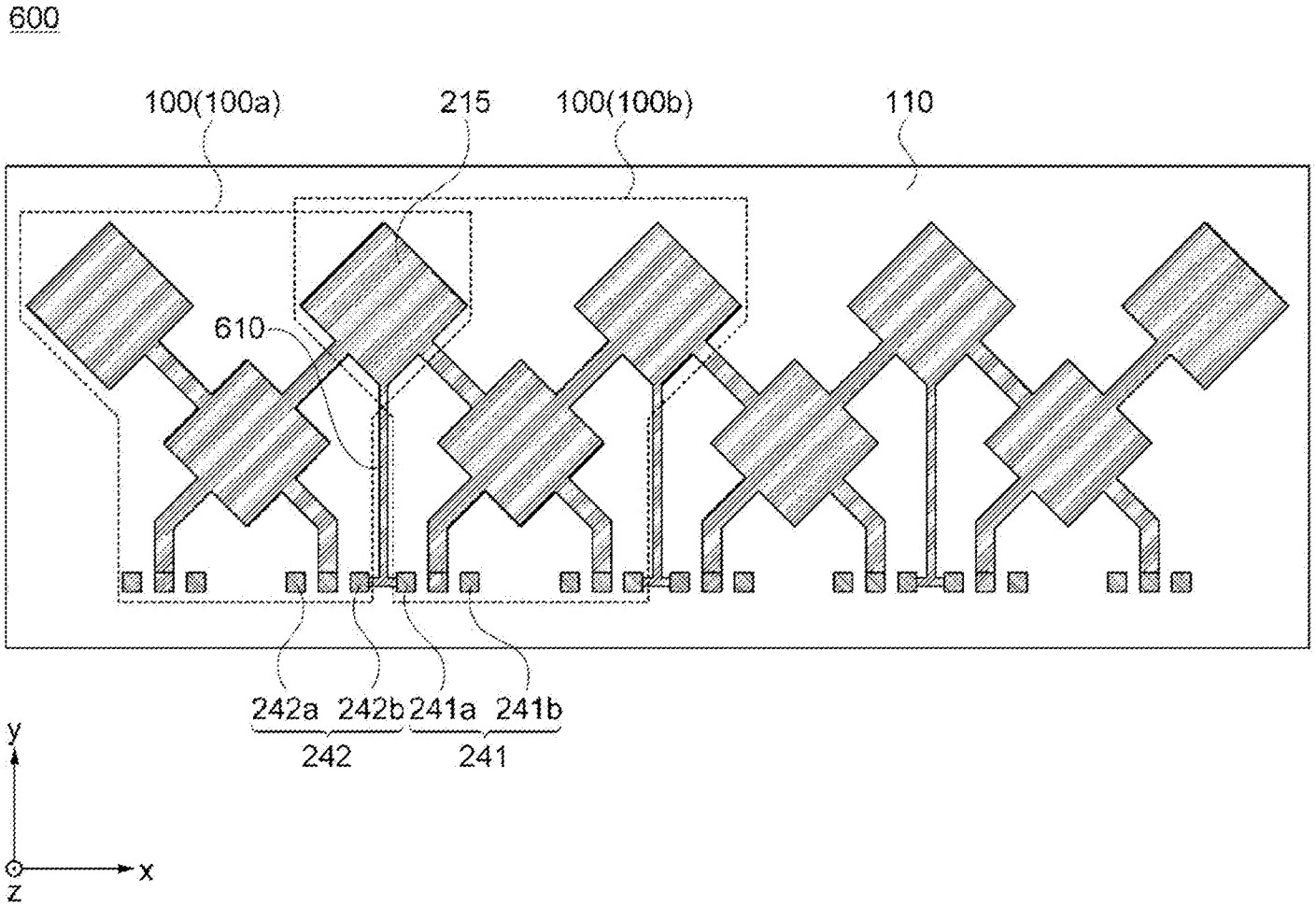

Referring to FIG. 6, an antenna array 600 according to an exemplary embodiment may further include a ground line 610 in the embodiment shown in FIGS. 4A and 4B.

The ground line 610 may be disposed on the dielectric layer 110 to connect the radiation body 215 shared by the adjacent antenna elements 100*a* and 100*b* to at least one of ground pads 241 and 242. For example, as shown in FIG. 6, the ground line 610 may include a first segment extending in the width direction (x-direction) of the antenna element 100 to connect a second ground pad 242*b* of a first antenna element 100*a* and a first ground pad 241*a* of a second antenna element 100*b* adjacent to the first antenna element 100*a*, and a second segment extending in the longitudinal direction (y-direction) of the antenna element 100 to connect the first segment and the radiation body 215. In this case, the second segment may be connected to a vertex of the radiation body 215.

In the case of a dual polarization antenna such as the antenna array 400 shown in FIGS. 4A and 4B, in which one radiation body 215 is shared by adjacent antenna elements 100*a* and 100*b*, polarization separation may be difficult due to an influence of unwanted cross-coupling or isolation. Therefore, according to an exemplary embodiment, the antenna array 600 may connect the radiation body 215 shared by the adjacent antenna elements 100*a* and 100*b* to the at least one of the ground pads 241 and 242 through a ground line 610, thereby reducing an occurrence of the unwanted cross-coupling.

According to an exemplary embodiment, the ground line 610 may include substantially the same conductive material as the radiation body 215 and/or the ground pads 241 and 242. In addition, the ground line 610 may be integrally connected with the radiation body 215 and/or the ground pads 241 and 242 to form a substantially single member, or may be formed as a separate member from the radiation body 215 and/or the ground pads 241 and 242.

According to an exemplary embodiment, the ground line 610 may be formed in a mesh structure or a solid structure (thin film or thick film).

Figure 7:
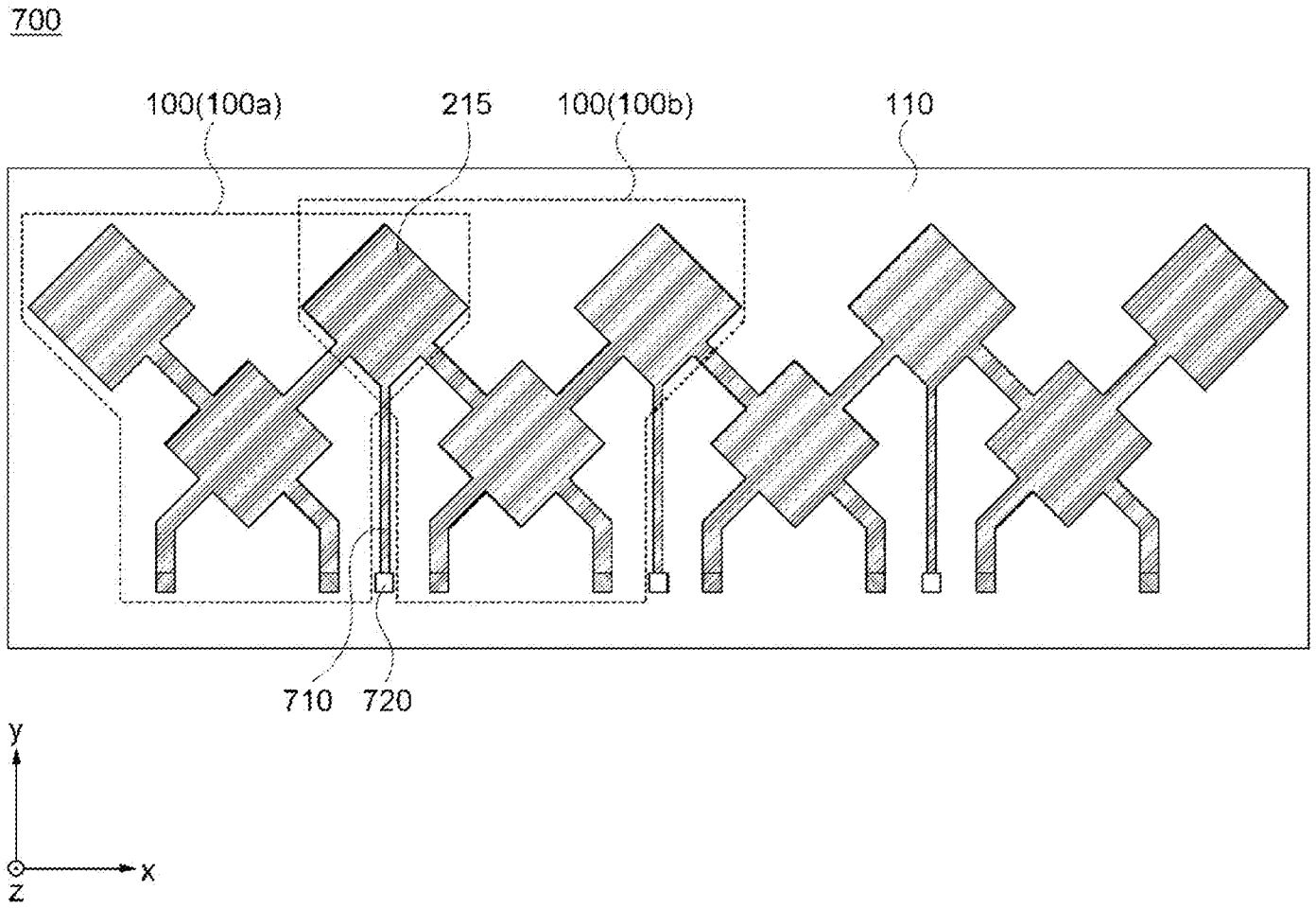

Referring to FIG. 7, an antenna array 700 according to an exemplary embodiment may further include a ground line 710 and a bonding pad 720 in the embodiment shown in FIG. 5.

The ground line 710 may be disposed on the dielectric layer 110 and may extend in the longitudinal direction (y-direction) of the antenna element 100 to be connected to the radiation body 215. The bonding pad 720 bonded to a ground (see 1222 of FIG. 12) of the FPCB may be disposed at an end of the ground line 710.

The bonding pad 720 is bonded to the ground of the FPCB, and the ground line 710 is connected to the ground of the FPCB, such that the radiation body 215 may be connected to the ground of the FPCB. Thereby, it is possible to reduce an occurrence of the unwanted cross-coupling.

According to an exemplary embodiment, the ground line 710 may include the above-described metal or alloy, and may be formed in a mesh structure or a solid structure (thin film or thick film). Also, the bonding pad 720 may include the above-described metal or alloy, and may be formed in a solid structure (thin film or thick film).

Figure 8A:
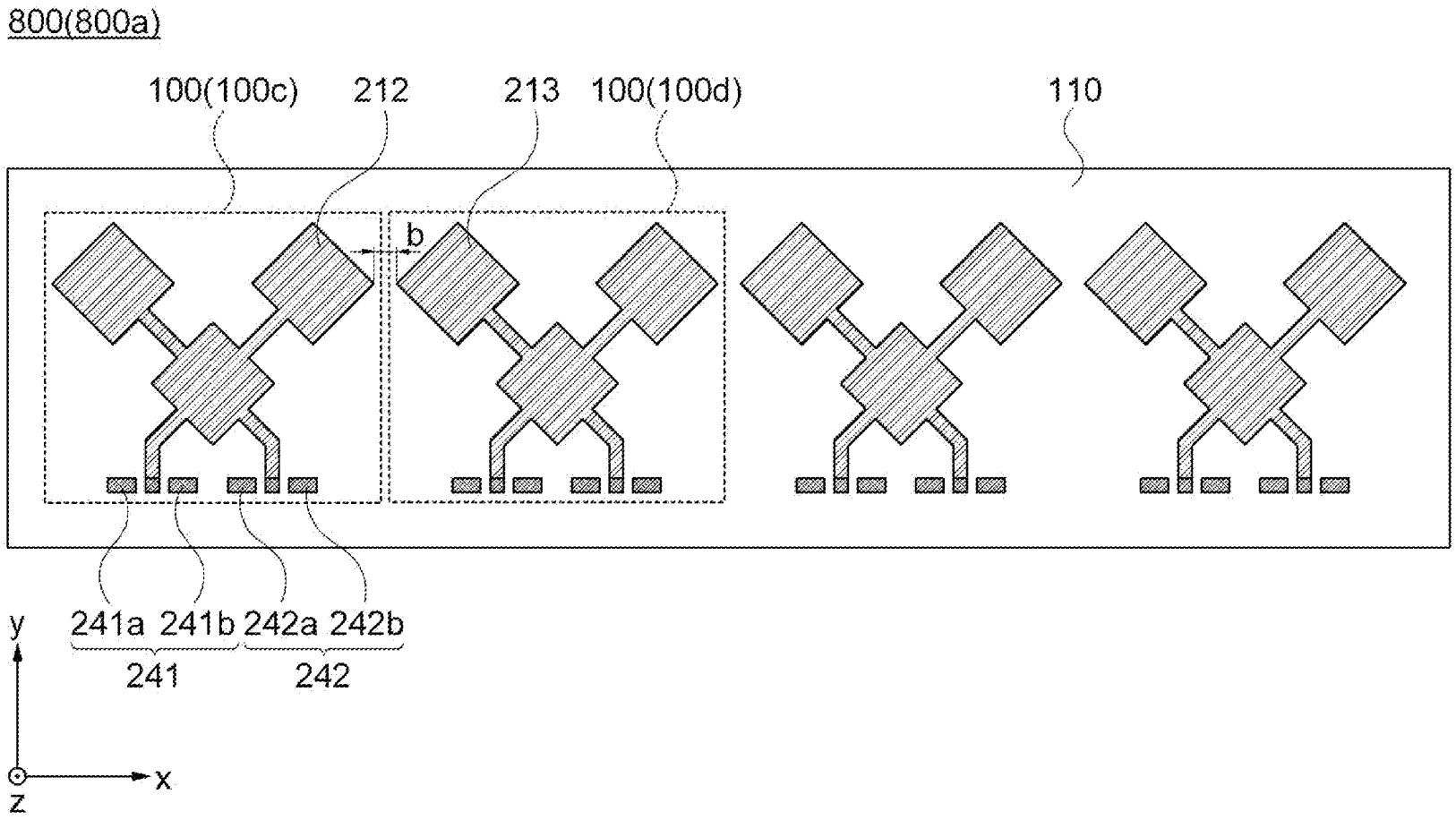
Figure 8B:
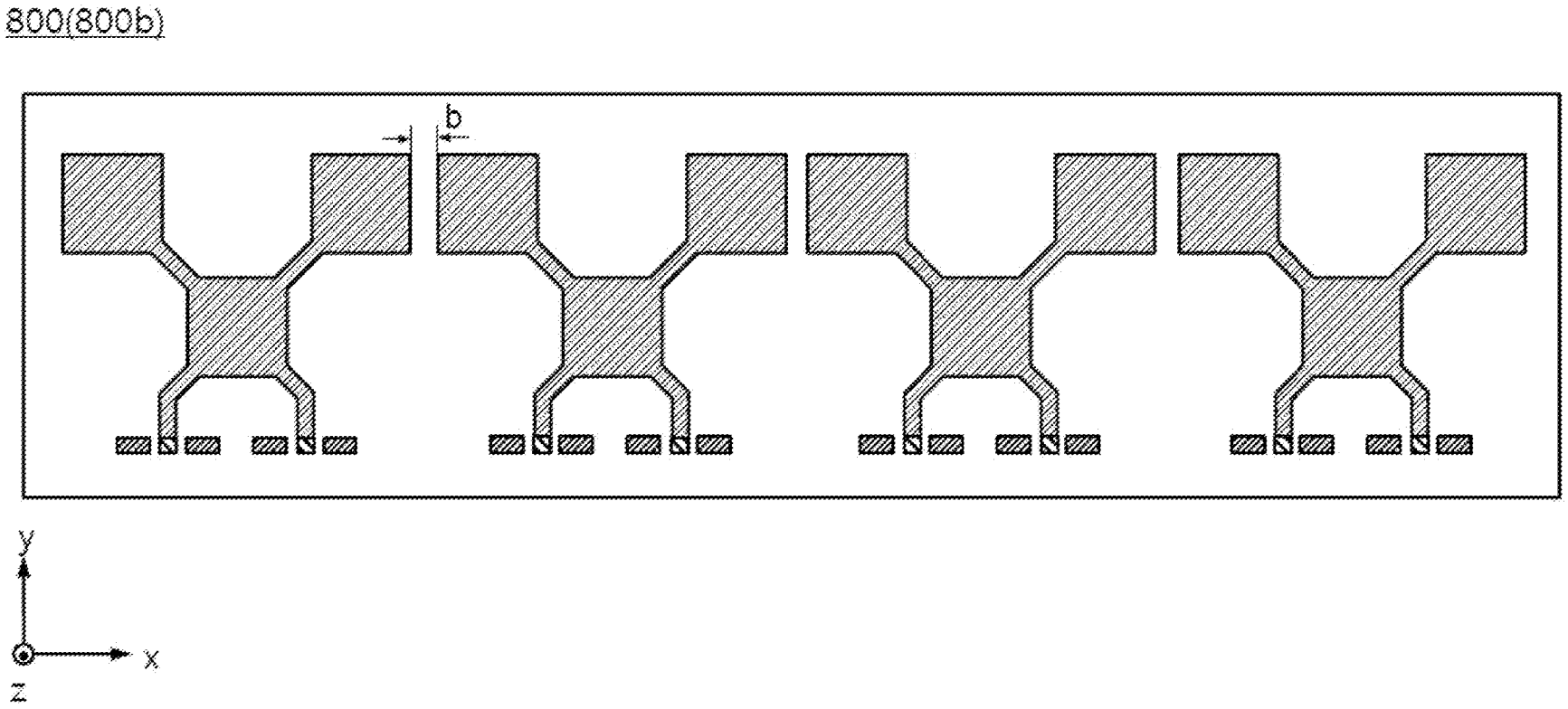

Referring to FIGS. 8A and 8B, an antenna array 800 according to an exemplary embodiment may include a plurality of antenna elements 100 arranged to be spaced apart from each other in the width direction (x-direction) of the antenna element 100. In this case, the antenna element 100 may include ground pads 241 and 242.

When the adjacent antenna elements 100 are located close to each other, unwanted coupling may occur between adjacent antenna elements 100, in particular, a second radiation body 212 of a first antenna element 100*c* and a third radiation body 213 of a second antenna element 100*d* adjacent to the first antenna element 100*c*. Such the coupling may affect the isolation and radiation efficiency of the antenna. Therefore, according to an exemplary embodiment, a separation distance b of the adjacent antenna elements 100 may be 0.5 mm or more, so as to reduce an occurrence of the unwanted coupling between the adjacent antenna elements 100.

Unlike the embodiment shown in FIGS. 4A and 4B, since the adjacent antenna elements 100 of FIGS. 8A and 8B do not share the radiation body, it is possible to reduce an occurrence of the unwanted cross-coupling.

Figure 9:
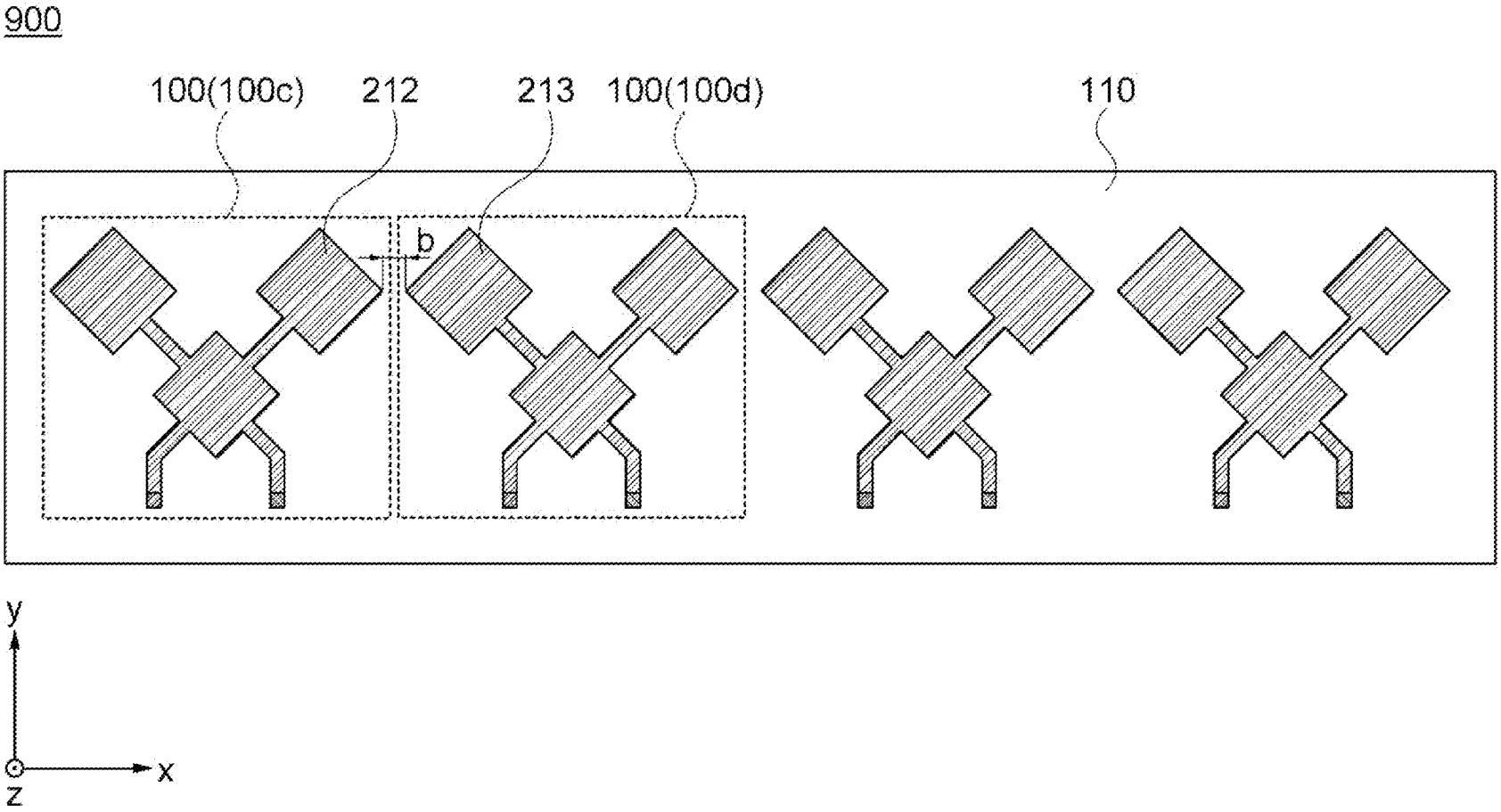

Referring to FIG. 9, unlike the embodiment shown in FIGS. 8A and 8B, the ground pads 241 and 242 may be omitted in an antenna array 900 according to an exemplary embodiment.

When the radiation bodies 211, 212 and 213 are located close to the ground pads 241 and 242, unwanted coupling may occur between the radiation bodies 211, 212 and 213, and the ground pads 241 and 242. Such the coupling may affect the isolation and radiation efficiency of the antenna. Therefore, according to an exemplary embodiment, the ground pads 241 and 242 of the antenna element 100 may be removed, so as to reduce an occurrence of the unwanted coupling between the radiation bodies 211, 212, 213, 311, 312 and 313, and the ground pads 241 and 242.

Figure 10:
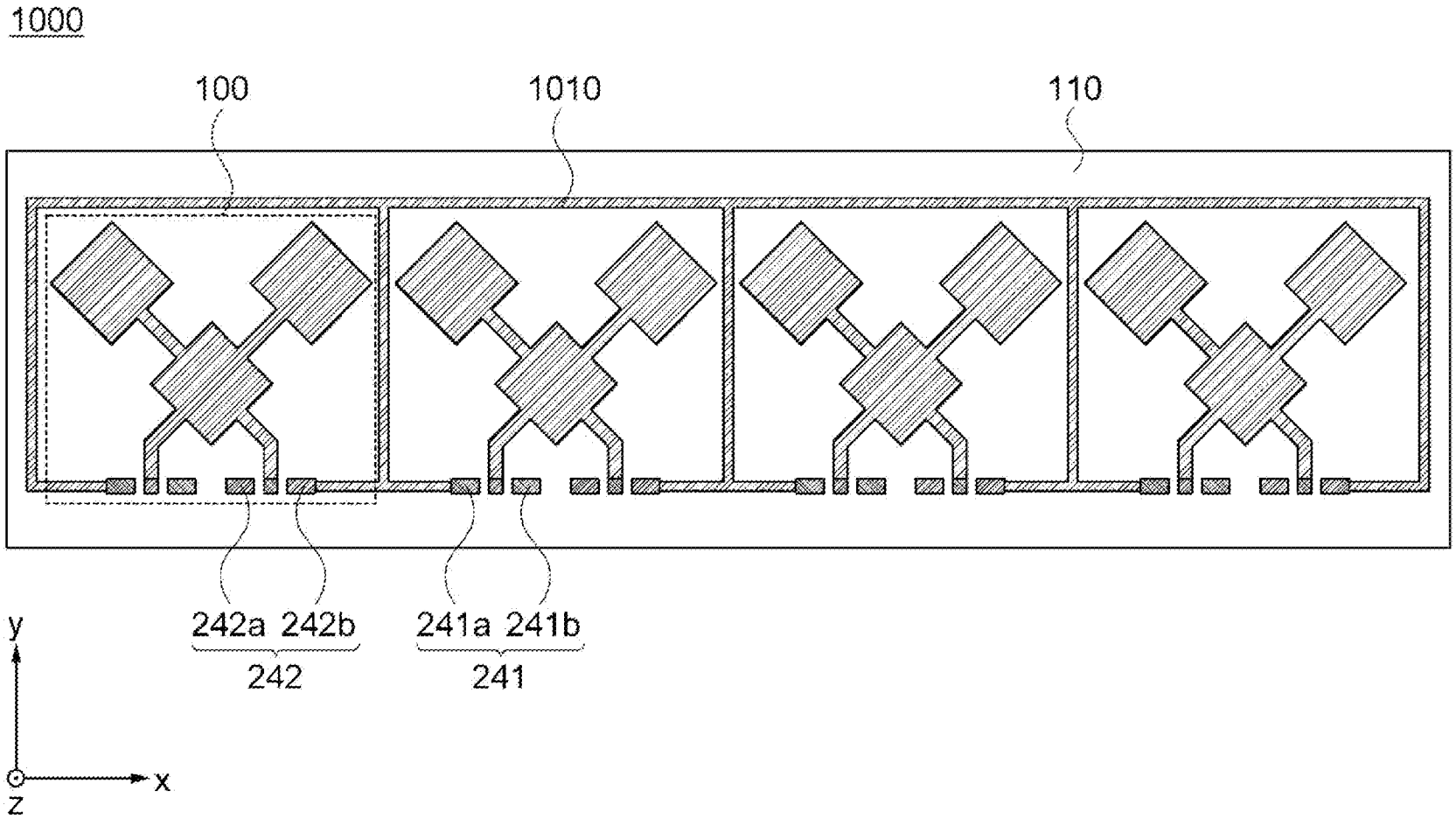

Referring to FIG. 10, an antenna array 1000 according to an exemplary embodiment may further include a boundary ground line 1010 in the embodiment shown in FIGS. 8A and 8B.

The boundary ground line 1010 may be disposed between adjacent antenna elements 100 on the dielectric layer 110 to be connected to ground pads 241 and 242. For example, as shown in FIG. 10, the boundary ground line 1010 may include a first segment extending in the width direction (x-direction) of the antenna element 100 to connect the ground pads 241 and 242 of the adjacent antenna elements 100, a second segment surrounding the antenna elements 100, and a third segment extending in the longitudinal direction (y-direction) of the antenna element 100 between the adjacent antenna elements 100 to connect the first segment and the second segment. In this case, ends of the second segment may be connected to the ground pads 241 and 242 of the antenna elements 100.

When the adjacent antenna elements 100 are located close to each other, unwanted coupling may occur between the adjacent antenna elements 100. Such the coupling may affect the isolation and radiation efficiency of the antenna. Therefore, according to an exemplary embodiment, the boundary ground line 1010 may be disposed between the adjacent antenna elements 100, thereby reducing an occurrence of the unwanted coupling between the adjacent antenna elements 100.

According to an exemplary embodiment, the boundary ground line 1010 may include substantially the same conductive material as the radiation bodies 211, 212 and 213 and/or the ground pads 241 and 242. Further, the boundary ground line 1010 may be integrally connected with the radiation bodies 211, 212 and 213 and/or the ground pads 241 and 242 to form a substantially single member, or may be formed as a separate member from the radiation bodies 211, 212 and 213 and/or the ground pads 241 and 242.

According to an exemplary embodiment, the boundary ground line 1010 may be formed in a mesh structure or a solid structure (thin film or thick film).

Figure 11:
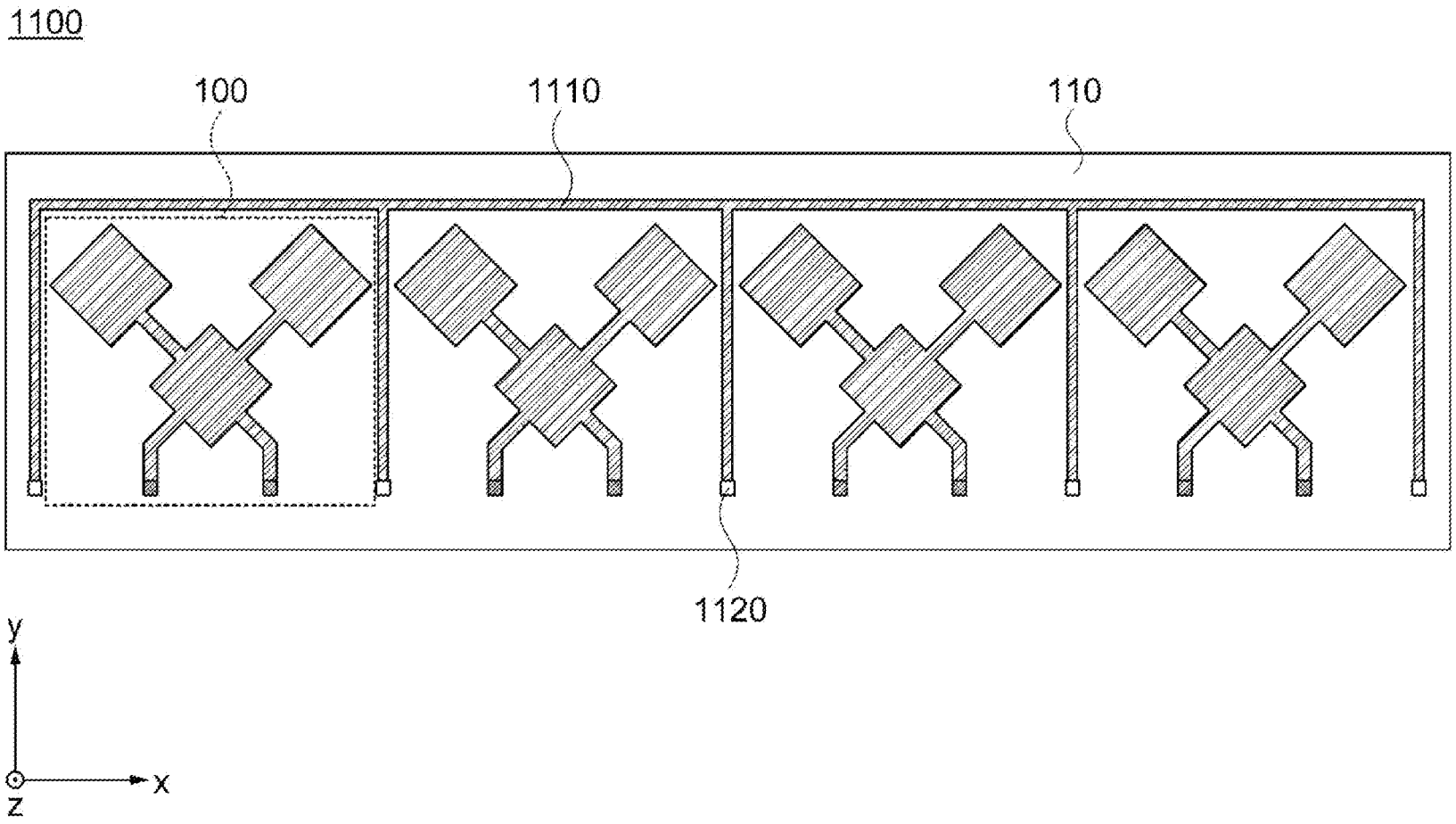

Referring to FIG. 11, an antenna array 1100 according to an exemplary embodiment may further include a boundary ground line 1110 and a bonding pad 1120 in the embodiment shown in FIG. 9.

The boundary ground line 1110 may be disposed between adjacent antenna elements 100 on the dielectric layer 110. For example, the boundary ground line 1110 may include a first segment extending in the longitudinal direction (y-direction) of the antenna element 100 between adjacent antenna elements 100 to be connected to a second segment, and a second segment surrounding the antenna elements 100.

The bonding pad 1120 bonded to the ground (see 1222 of FIG. 12) of the FPCB may be connected to an end of the boundary ground line 1110.

The bonding pad 1120 may be bonded to the ground of the FPCB, such that the boundary ground line 1110 may be connected to the ground of the FPCB. Thereby, it is possible to reduce an occurrence of the unwanted coupling between the adjacent antenna elements 100.

According to an exemplary embodiment, the boundary ground line 1110 may include the above-described metal or alloy, and may be formed in a mesh structure or a solid structure (thin film or thick film). In addition, the bonding pad 1120 may include the above-described metal or alloy, and may be formed in a solid structure (thin film or thick film).

Figure 12:
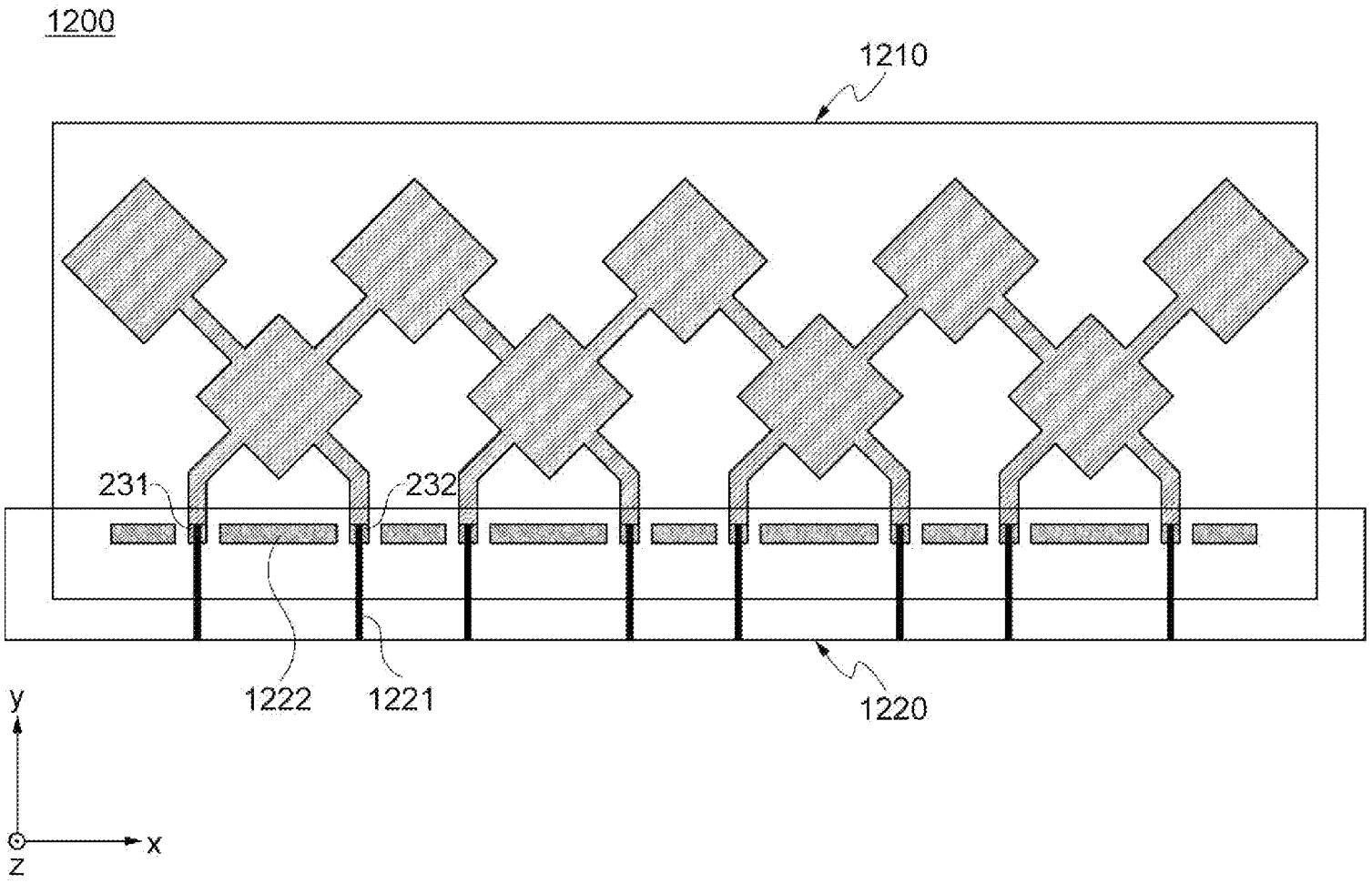
FIGS. 12 and 13 are plan views illustrating antenna devices according to exemplary embodiments.
Figure 13:
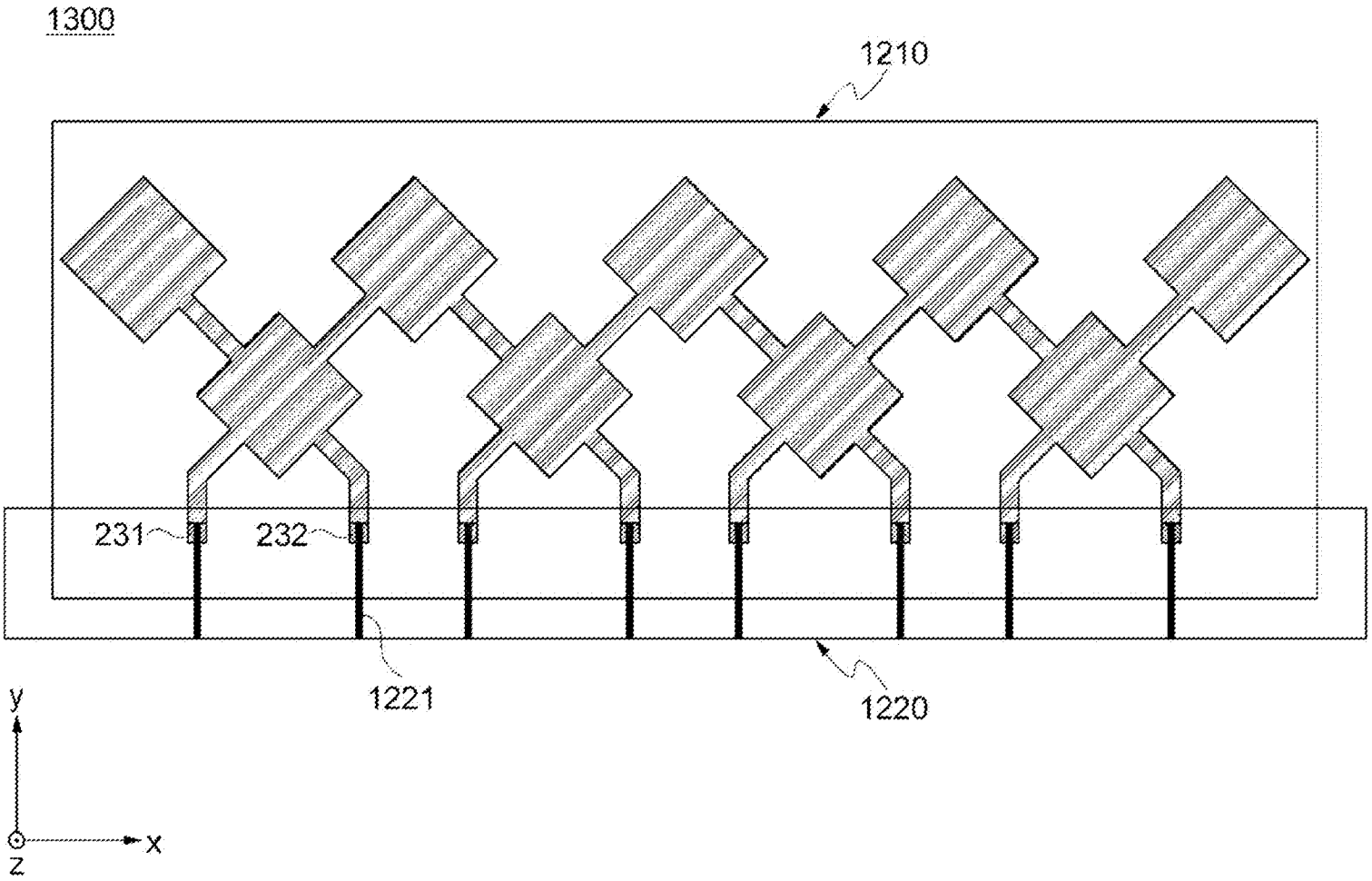

FIGS. 12 and 13 are plan views illustrating antenna devices according to exemplary embodiments. In the description of FIGS. 12 and 13, details of the contents substantially the same as those of the structures and configurations described with reference to FIGS. 1 to 11 will not be described.

Referring to FIGS. 12 and 13, antenna devices 1200 and 1300 according to exemplary embodiments may include an antenna array 1210 and an FPCB 1220.

Herein, the antenna array 1210 may be the antenna arrays 500, 700, 900 and 1100 which are described above with reference to FIGS. 5, 7, 9 and 11. That is, the antenna array 1210 may be an antenna array from which the ground pads 241 and 242 are removed.

The FPCB 1220 may include a plurality of circuit wirings 1221 electrically connected to the respective signal pads 231 and 232. In this case, the FPCB 1220 may include grounds 1222 corresponding to the ground pads 241 and 242 removed from the antenna array 1210 (see FIG. 12) or may not include the same (see FIG. 13). As shown in FIG. 12, if the FPCB 1220 includes the grounds 1222, each ground 1222 may be disposed at a position of the FPCB 1220, in which the signal pads 231 and 232 of the antenna array 1210 face each other with it interposed therebetween, when the antenna array 1210 is bonded to the FPCB 1220.

Meanwhile, when the antenna array 1210 is the antenna array 700 or 1100 shown in FIG. 7 or 11, the bonding pads 720 and 1120 may be bonded to the grounds 1222 of the FPCB 1220. Thereby, the ground line 710 and the boundary ground line 1110 may be connected to the ground 1222 of the FPCB 1220.

Figure 14:
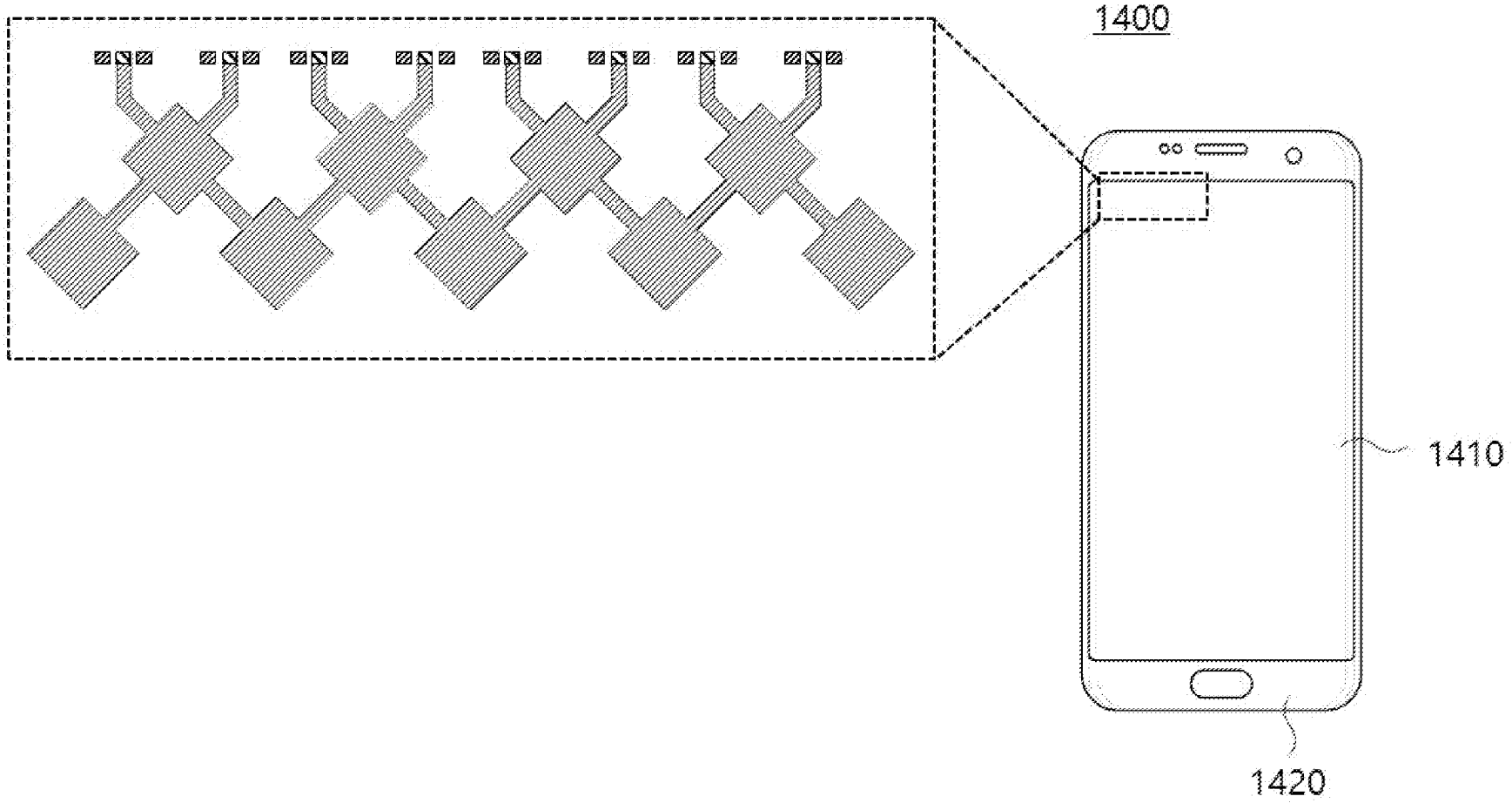
FIG. 14 is a schematic plan view illustrating a display device according to an exemplary embodiment.

FIG. 14 is a schematic plan view illustrating a display device according to an exemplary embodiment. More specifically, FIG. 14 is a plan view illustrating an external shape including a window of the display device.

Referring to FIG. 14, a display device 1400 may include a display region 1410 and a peripheral region 1420.

The display region 1410 may indicate a region in which visual information is displayed, and the peripheral region 1420 may indicate an opaque region disposed on both sides and/or both ends of the display region 1410. For example, the peripheral region 1420 may correspond to a light-shielding part or a bezel part of the display device 1400.

According to an embodiment, the above-described antenna elements 100, 200 and 300, the antenna arrays 400, 500, 600, 700, 800, 900, 1000 and 1100, or the antenna devices 1200 and 1300 may be mounted on the display device 1400. For example, the radiation bodies 211, 212, 213, 311, 312 and 313, the transmission lines 221, 222, 223 and 224, the ground line 710 and the boundary ground line 1110 of the antenna elements 100, 200 and 300, the antenna arrays 400, 500, 600, 700, 800, 900, 1000 and 1100, and the antenna devices 1200 and 1300 may be disposed so as to at least partially correspond to the display region 1410, and the signal pads 231 and 232, the ground pads 241 and 242, and the bonding pads 720 and 1120 may be arranged so as to correspond to the peripheral region 1420.

The FPCB or PCB may be disposed in the peripheral region 1420 together with an antenna driving unit (e.g., RFIC). By arranging the antenna elements 100, 200 and 300, the antenna arrays 400, 500, 600, 700, 800, 900, 1000 and 1100, and the signal pads 231 and 232 of the antenna devices 1200 and 1300 so as to be adjacent to the antenna driving unit, signal loss may be suppressed by shortening a path for transmitting and receiving signals.

The antenna elements 100, 200 and 300, the antenna arrays 400, 500, 600, 700, 800, 900, 1000 and 1100, and the antenna devices 1200 and 1300 include the radiation bodies 211, 212, 213, 311, 312 and 313, the transmission lines 221, 222, 223 and 224 and/or the dummy pattern, which are formed in the mesh structure, such that it is possible to significantly reduce or suppress the patterns from being viewed while improving the transmittance. Accordingly, image quality in the display region 1410 may also be improved while maintaining or improving desired communication reliability.

The present invention has been described with reference to the preferred embodiments above, and it will be understood by those skilled in the art that various modifications may be made within the scope without departing from essential characteristics of the present invention. Accordingly, it should be interpreted that the scope of the present invention is not limited to the above-described embodiments, and other various embodiments within the scope equivalent to those described in the claims are included within the present invention.

What is claimed is:

1. An antenna device comprising:

an antenna array comprising a plurality of antenna elements arranged in a predetermined direction, each antenna element comprising:

a first radiation body;

a second radiation body disposed to be spaced apart from the first radiation body in a first direction;

a third radiation body disposed to be spaced apart from the first radiation body in a second direction;

a first signal pad and a second signal pad configured to supply signals to the first radiation body;

a first transmission line extending in the first direction to connect the first signal pad and the first radiation body;

a second transmission line extending in the second direction to connect the second signal pad and the first radiation body;

a third transmission line configured to connect the first radiation body and the second radiation body; and a fourth transmission line configured to connect the first radiation body and the third radiation body;

wherein a flexible printed circuit board is bonded to the antenna array, the flexible printed circuit board comprising a plurality of circuit wirings connected to the first signal pad and the second signal pad.

2. The antenna device according to claim 1, wherein the plurality of antenna elements are arranged to share at least a portion thereof with each other.

3. The antenna device according to claim 2, wherein the plurality of antenna elements comprises a first antenna element and a second antenna element which are adjacent to each other, and the first antenna element and the second antenna element share one radiation body with each other.

4. The antenna device according to claim 3, wherein the shared one radiation body serves as the second radiation body of the first antenna element and the third radiation body of the second antenna element.

5. The antenna device according to claim 3, wherein the antenna further comprising:

a bonding pad; and a ground line configured to connect the bonding pad and the radiation body shared by the first antenna element and the second antenna element.

6. The antenna device according to claim 3, wherein each antenna element further comprises:

a first ground pad disposed around the first signal pad; and a second ground pad disposed around the second signal pad.

7. The antenna device according to claim 6, wherein the antenna further comprises a ground line configured to connect the radiation body shared by the first antenna element and the second antenna element and the first ground pad or the second ground pad.

8. The antenna device according to claim 1, wherein the plurality of antenna elements are arranged to be spaced apart from each other.

9. The antenna device according to claim 8, wherein a separation distance between adjacent antenna elements of the plurality of antenna elements is 0.5 mm or more.

10. The antenna device according to claim 8, wherein the antenna further comprises:

a boundary ground line disposed between adjacent antenna elements of the plurality of antenna elements; and a bonding pad connected to an end of the boundary ground line.

11. The antenna device according to claim 10, wherein the boundary ground line comprises:

a first segment extending in a longitudinal direction of the antenna element between the adjacent antenna elements; and a second segment connected with the first segment and surrounding the plurality of antenna elements.

12. The antenna device according to claim 8, wherein each antenna element further comprises:

a first ground pad disposed around the first signal pad; and a second ground pad disposed around the second signal pad.

13. The antenna device according to claim 12, wherein the antenna further comprises a boundary ground line disposed between adjacent antenna elements.

14. The antenna device according to claim 13, wherein the boundary ground line comprises:

a first segment configured to connect a first ground pad of one of the adjacent antenna elements to a second ground pad of the other one of the adjacent antenna elements;

a second segment surrounding the plurality of antenna elements; and a third segment extending between the adjacent antenna elements in the longitudinal direction of the antenna element to connect the first segment and the second segment.

15. The antenna device according to claim 1, wherein an angle between the first direction and the second direction is 80° to 100°.

16. The antenna device according to claim 1, wherein the first radiation body, the second radiation body and the third radiation body have a rhombus shape;

the first transmission line and the second transmission line are connected to two adjacent sides of the first radiation body, respectively;

the third transmission line connects two facing sides of the first radiation body and the second radiation body to each other; and the fourth transmission line connects two facing sides of the first radiation body and the third radiation body to each other.

17. The antenna device according to claim 1, wherein the first radiation body, the second radiation body and the third radiation body have a square shape;

the first transmission line and the second transmission line are connected to two adjacent vertices of the first radiation body, respectively;

the third transmission line connects two facing vertices of the first radiation body and the second radiation body to each other; and the fourth transmission line connects two facing vertices of the first radiation body and the third radiation body.

18. A display device comprising the antenna device according to claim 1.

19. The antenna device according to claim 1, wherein the flexible printed circuit board further comprises:

a plurality of grounds disposed at positions in which respective signal pads face each other with them interposed therebetween when the antenna array is bonded.

20. An antenna array comprising:

a plurality of antenna elements arranged in a predetermined direction, each antenna element comprising:

a first radiation body;

a second radiation body disposed to be spaced apart from the first radiation body in a first direction;

a third radiation body disposed to be spaced apart from the first radiation body in a second direction;

a first signal pad and a second signal pad configured to supply signals to the first radiation body;

a first transmission line extending in the first direction to connect the first signal pad and the first radiation body;

a second transmission line extending in the second direction to connect the second signal pad and the first radiation body;

a third transmission line configured to connect the first radiation body and the second radiation body;

a fourth transmission line configured to connect the first radiation body and the third radiation body;

a first ground pad disposed around the first signal pad; and a second ground pad disposed around the second signal pad.

* * * * *